US006957028B2

(12) United States Patent
Serizawa et al.

(10) Patent No.: US 6,957,028 B2
(45) Date of Patent: Oct. 18, 2005

(54) IMAGE FORMING APPARATUS HAVING A BLADE MEMBER WITH A SEMI-CONDUCTIVE MEMBER INSTALLED THERE ON

(75) Inventors: Takashi Serizawa, Tokyo (JP); Hiroaki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 31 days.

(21) Appl. No.: 10/642,579

(22) Filed: Aug. 19, 2003

(65) Prior Publication Data

US 2004/0037599 A1 Feb. 26, 2004

(30) Foreign Application Priority Data

Aug. 20, 2002 (JP) ..... 2002-239186

(51) Int. Cl.[7] ..... G03G 15/24; G03G 15/02; G03G 21/00

(52) U.S. Cl. ..... 399/148; 399/174; 399/350

(58) Field of Search ..... 399/148, 174, 399/350, 351

(56) References Cited

U.S. PATENT DOCUMENTS 5,749,030 A * 5/1998 Park ..... 399/148
6,021,304 A * 2/2000 Sbert et al. ..... 399/350
6,134,405 A * 10/2000 Zona ..... 399/148
6,640,070 B2 * 10/2003 Sanmonji ..... 399/350

FOREIGN PATENT DOCUMENTS

JP 62245281 10/1987
JP 06130778 5/1994

* cited by examiner

*Primary Examiner*—William J. Royer
(74) *Attorney, Agent, or Firm*—Rabin & Berdo, P.C.

(57) ABSTRACT

The present invention provides an image forming apparatus which is small-sized and is able to keep a longtime and stable cleaning function. The image forming apparatus includes an image carrier; a blade member contacting elastically with the image carrier; a semi-conductive member installed on the blade member; and a power unit for adding a voltage to the semi-conductive member. Further, the semi-conductive member is set apart from the contacting portion of the blade member by a predetermined isolation distance.

5 Claims, 4 Drawing Sheets

IMAGE FORMING APPARATUS HAVING A BLADE MEMBER WITH A SEMI-CONDUCTIVE MEMBER INSTALLED THERE ON

BACKGROUND OF THE INVENTION

1. Field of the Invention

The invention relates to an image forming apparatus.

2. Related Background Art

Conventionally, in an image forming apparatus, for example, a printing apparatus with electrophotography, copying apparatus or facsimile apparatus, in order to form an image, first an electrostatic latent image is formed on a photoconductor drum by using an electrifying device to electrify the surface of the photoconductor drum and using a LED (Light Emitting Diode) head to expose the surface of the photoconductor drum. Then a toner image is formed by using an image developing device made up of a blade and a developing roller and the like to develop the electrostatic latent image. The toner image is transferred on a recording medium, for example, a sheet or film by using a transference device. An image is formed by using a fixing device to fix the toner image transferred on the recording medium.

FIG. 2 is a drawing showing the main part of a conventional image forming apparatus.

In FIG. 2, 11 is a photoconductor drum set rotating-freely along an arrow direction, 12 is an electrifying device to electrify uniformly and equally the photoconductor drum 11. The electrifying device 12 comprises an electrifying roller 13 which contacts with the photoconductor drum 11 and is set rotating-freely, and a power unit 14 supplies a surface electric potential of −700V to the electrifying roller 13.

Further, 15 is a cleaning device for removing the toner (hereinafter: residual toner) remaining on the surface of the photoconductor drum 11. The cleaning device 15 comprises a cleaning blade 16 formed from an elastic material, for example, urethane rubber, and a bracket 17 for supporting the cleaning blade 16. The cleaning blade 16 has a JIS hardness of 60 degrees, a thickness of 2.0 mm, and a projecting portion with a length of 9.5 mm, projecting from the tip of the bracket 17. Further, the cleaning blade 16 has a slant angle H (53.4°) with respect to a line extending from the center of the photoconductor drum 11 along the radial direction and is pressed with a predetermined pressure by the photoconductor drum 11. Thus, while the photoconductor drum 11 rotates, the residual toner is scraped away by the cleaning device 15. Moreover, the photoconductor drum 11, the electrifying device 12 and the cleaning device 15 construct the image forming apparatus.

When the image forming apparatus starts to be used, in order to prevent the tip of the cleaning blade 16 from being rolled up, the toner with insulation efficiency is previously smeared on the tip of the cleaning blade 16. Thus, the early torque of the photoconductor drum 11 becomes small.

However, because the electrifying device 12 and the cleaning device 15 are set in the conventional image forming apparatus, the image forming apparatus becomes big.

Therefore, a cleaning blade which has an electrifying function for electrifying the surface of a photoconductor drum and a cleaning function for removing residual toner is provided (refer to the Japanese Patent Publication No. 6-130778).

FIG. 3 is a drawing showing the main part of a conventional image forming apparatus.

In FIG. 3, 11 is a photoconductor drum set rotating-freely along an arrow direction, and 21 is an electrifying/cleaning device for electrifying uniformly and equally the photoconductor drum 11, while removing residual toner after transferring. The electrifying/cleaning device 21 comprises a cleaning blade 22 with semi-conductivity, a bracket 23 for supporting the cleaning blade 22, and a power unit 24 supplying a predetermined voltage to the cleaning blade 22 so that the photoconductor drum 11 has a predetermined surface electric potential.

The cleaning blade 22 is formed by mixing conductive particles, for example, carbon black into urethane rubber serving as an elastic material, and has a cubic resistance of $10^6$–$10^9$ (Ω·cm).

However, in other conventional image forming apparatus, when performing printing continually, the edge portion of the cleaning blade 22 is worn away so as to become nicked. Thereby, it is impossible to keep a cleaning function. This is because the hardness of the rubber drops so that the durability of the cleaning blade 22 is gone.

SUMMARY OF THE INVENTION

To solve the conventional problems as mentioned above, the present invention supplies an image forming apparatus not only capable of becoming small-sized, but also capable of keeping a longtime cleaning function.

According to the invention, there is provided an image forming apparatus, comprising:

an image carrier;

a blade member having a contacting portion contacting elastically with the image carrier;

a semi-conductive member installed on the blade member; and a power unit for adding a voltage to the semi-conductive member.

wherein the semi-conductive member is set apart from the contacting portion of the blade member by a predetermined isolation distance Lb.

In the image forming apparatus, the isolation distance Lb may be set as follows:

$$0<Lb\leqq 1.0 \text{ mm.}$$

Further, the isolation distance Lb may be set as follows:

$$0.7<Lb\leqq 0.8 \text{ mm.}$$

Moreover, the semi-conductive member may be a tape with semi-conductivity, also, the semi-conductive member may be a resin plate with semi-conductivity.

The above and other objects and features of the present invention will become apparent from the following detailed description and the appended claims with reference to the accompanying drawings.

DETAILED DESCRIPTION OF THE PREFERRED EMBODIMENTS

With respect to embodiments of the present invention, while referring to diagrams, the following is to explain them in detail.

In embodiments, serving as an image forming apparatus, a printer which performs a printing, i.e. image formation with respect to a printing medium.

<Embodiment 1>

Figure 4:
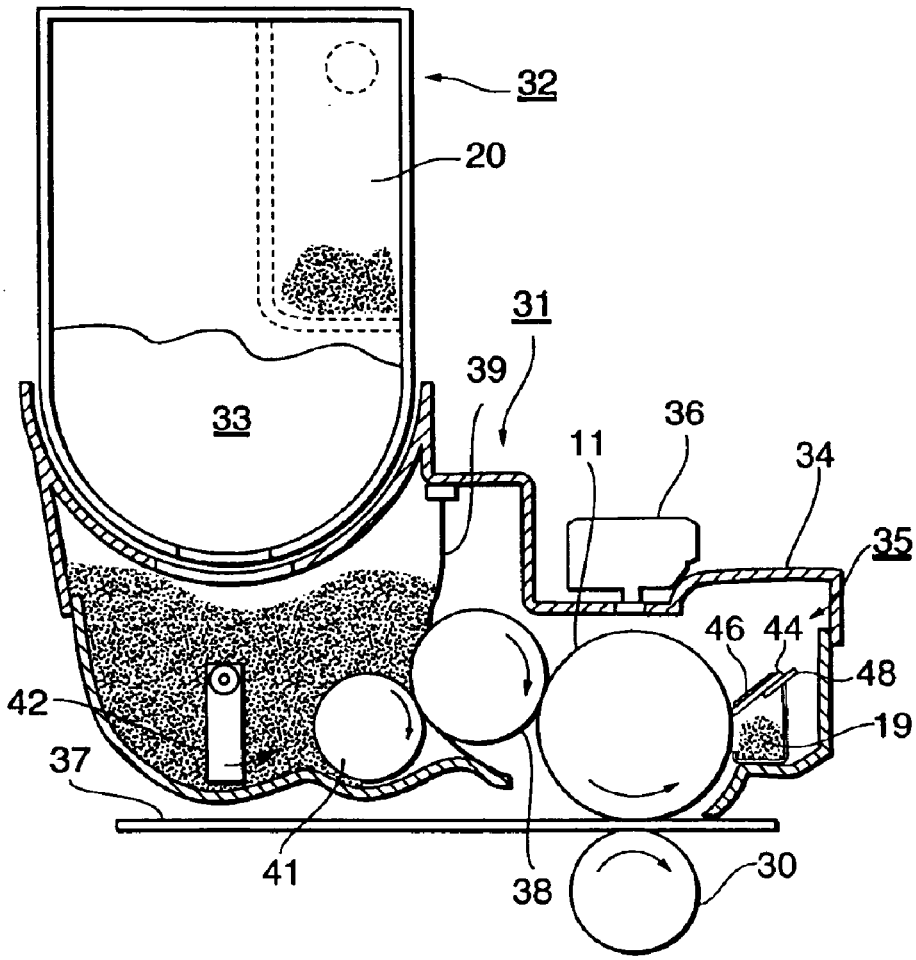
FIG. 4 is a drawing showing a printer of the present invention in embodiment 1.

FIG. 4 is a summary drawing showing a printer of the present invention in embodiment 1.

In FIG. 4, 31 is a cartridge, 32 is a toner accommodating section set on the cartridge 31 for accommodating the toner 33, and 37 is a recording medium like paper or an OHP sheet. The cartridge 31 comprises a case 34, a photoconductor drum 11 serving as an image carrier set to rotate freely along an arrow direction, an electrifying/cleaning device 35 for electrifying uniformly and equally the photoconductor drum 11 while removing the residual toner after transferring, a an image developing roller 38 which is set to contact with the photoconductor drum 11 and serves as a toner carrier rotating in an a arrow direction, an image developing blade 39 which is pressed by the image developing roller 38 and is used to form a thin layer of the toner 33 on the surface of the image developing roller 38, a toner providing roller 41 which is set to contact with the image developing roller 38 and serves as a toner providing member and rotates in an arrow direction, and a stirring rod 42 which rotates in an arrow direction and supplies the toner 33 that is dropped from the toner accommodating section 32 to the toner providing roller 41. Moreover, by the image developing roller 38, the image developing blade 39, the toner providing roller 41, the stirring rod 42, and other features, an image developing device is formed.

Further, on the case 34, an LED head 36 serves as an exposing device and is set to face the photoconductor drum 11. A transferring roller 30 is set under the case to rotate freely in an arrow direction and contacts with the photoconductor drum 11, and is used to construct a transferring device. Moreover, the cartridge 31, the LED head 36, the transferring roller 30 and other features construct a printer.

In the printer, for example, the surface of the photoconductor drum 11 is electrified uniformly and equally, then an electrostatic latent image is formed on the exposed photoconductor drum 11 by the LED (Light Emitting Diode ) head 36. Further, a toner image is formed on the photoconductor drum 11 by using the image developing device to develop the electrostatic latent image. Moreover, the toner image is transferred on the recording medium 37 by using the transferring roller 30. Then, the recording medium 37 is sent to a fixing device (not shown) to fix the toner image on the recording medium 37. Thus, the printing is performed.

After the toner image is transferred, the residual toner remaining on the surface of the photoconductor drum 11 is scraped away by the electrifying/cleaning device 35. Then, the waste toner 19 is accommodated into a waste toner room 20 as a part of the toner accommodating section 32.

As described above, in this embodiment, because the electrifying/cleaning device 35 not only has an electrifying function, but also has a cleaning function, there is no need to set an electrifying roller. Therefore, it is possible to make the printer small-sized and to reduce the cost of the printer.

Figure 1:
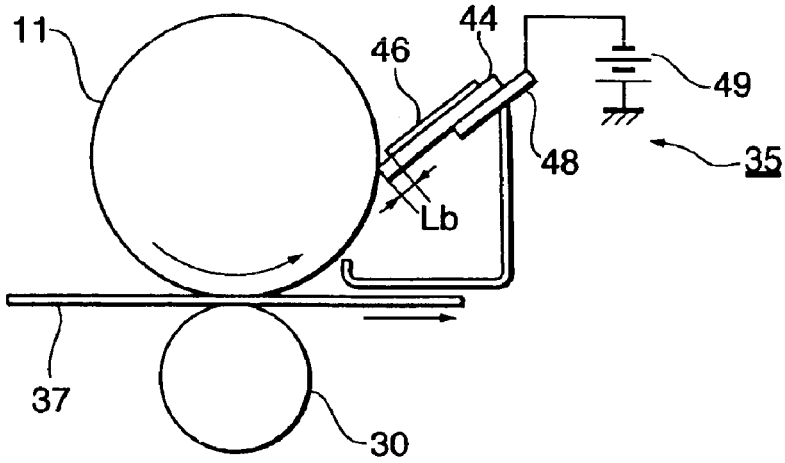
FIG. 1 is a drawing showing the main part of a printer of the present invention in embodiment 1.
Figure 5:
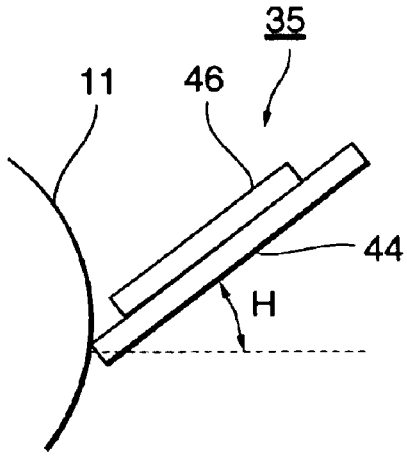
FIG. 5 is an expanded drawing showing the main part of a printer of the present invention in embodiment 1.
Figure 6:
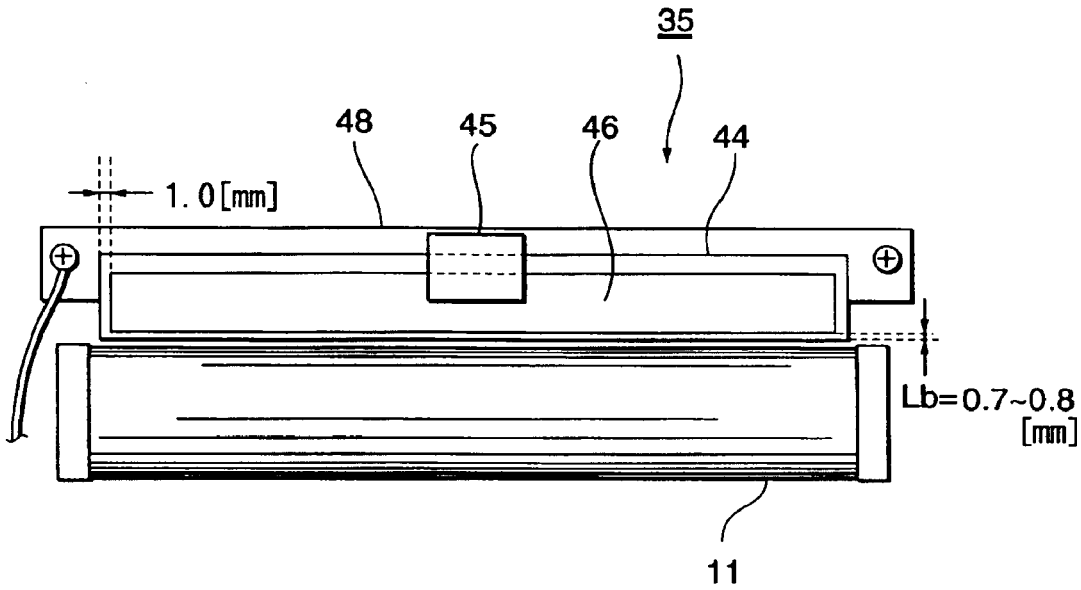
FIG. 6 is a front view showing the main part of a printer of the present invention in embodiment 1.
Figure 7:
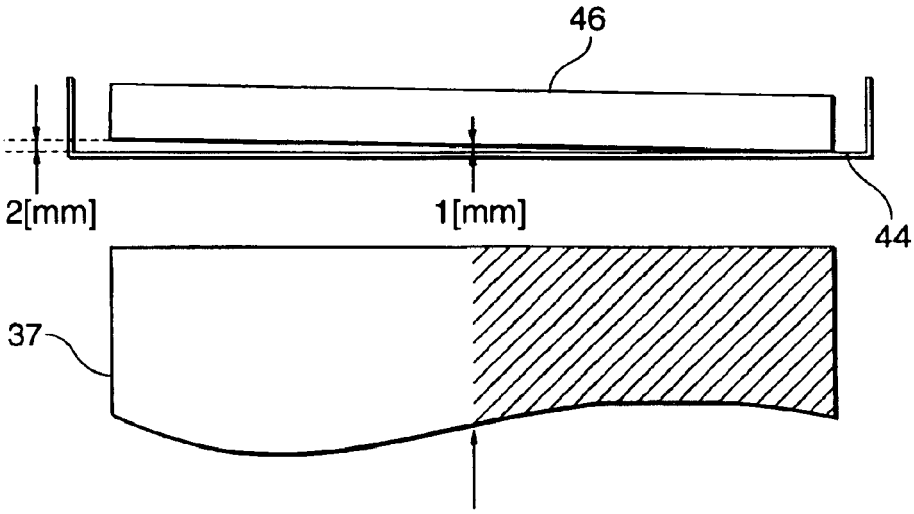
FIG. 7 is an explanation diagram showing a relation between the isolation distance and the printing state in embodiment 2.

FIG. 1 is a drawing showing the main part of a printer of the present invention in embodiment 1; FIG. 5 is an expanded drawing showing the main part of a printer of the present invention in embodiment 1; FIG. 6 is a front view showing the main part of a printer of the present invention in embodiment 1; and FIG. 7 is an explanation diagram showing a relation between the isolation distance and the printing state.

In these drawings, 11 is a photoconductor drum, 30 is a transferring roller, and 35 is an electrifying/cleaning device.

The electrifying/cleaning device 35 comprises a cleaning blade 44 which serves as a blade member and whose tip is set to contact elastically with the photoconductor drum 11; a bracket 48 serves as a supporting member for supporting the cleaning blade 44 and is made of metal like steel plate; a power unit 49 of direct current supplies a predetermined voltage to the photoconductor drum 11 so that the photoconductor drum 11 has a predetermined surface electric potential; a tape 46 with semi-conductivity serves as a semi-conductive member stuck on the cleaning blade 44; and a conductive tape 45 which is made of a conductive material is connected electrically with the bracket 48 and the tape 46 with semi-conductivity.

In the embodiment, the tape 46 with semi-conductivity is installed so as to be stuck on the cleaning blade 44. Replacing it, the tape 46 may be installed by other means, for example, fixing means using a fixing member, joining means using a joining member, or fusing means using a fusing member. Moreover, the power unit 49 adds a predetermined voltage to the bracket 48 so that the photoconductor drum 11 is provided with a predetermined voltage.

Further, in the embodiment, the tip of the cleaning blade 44 contacts with the photoconductor drum 11. The tip of the cleaning blade 44 may be formed to have a curved shape, then, its curved surface may contact with the photoconductor drum 11.

Moreover, the cleaning blade 44 has a JIS hardness of 60 degrees, a thickness of 2.0 mm, and a projecting portion with a length of 9.5 mm, projecting from the tip of the bracket 48. Further, the cleaning blade 44 has a slant angle H (53.4°) (FIG. 5) with respect to the a line extending from the center of the photoconductor drum 11 along a radial direction and is pressed with a predetermined pressure by the photoconductor drum 11. Thus, while the photoconductor drum 11 rotates, the residual toner is scraped away by the electrifying/cleaning device 35.

In this embodiment, in order to make the cleaning blade 44 contact elastically with the photoconductor drum 11, the cleaning blade 44 is formed by an elastic member. Replacing the elastic member with a spring or the like, it is possible to make the cleaning blade 44 have an elastic function. In this case, it is not necessary to form the cleaning blade 44 of an elastic member.

Figure 2:
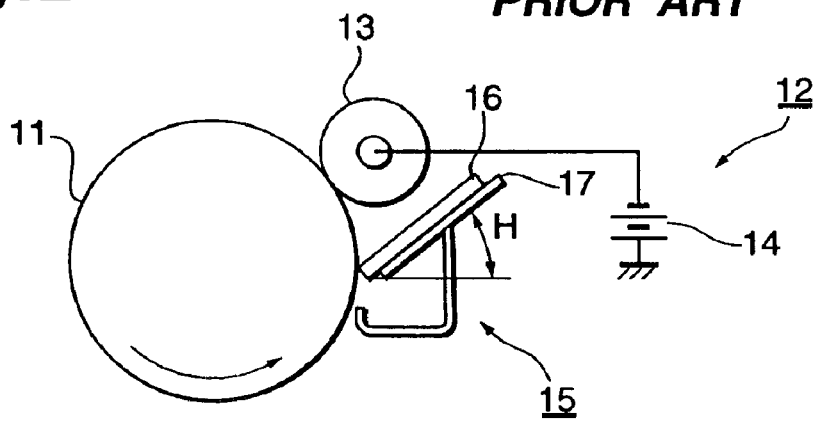
Fig.2 PRIOR ART
FIG. 2 is a drawing showing the main part of one conventional image forming apparatus.
Figure 3:
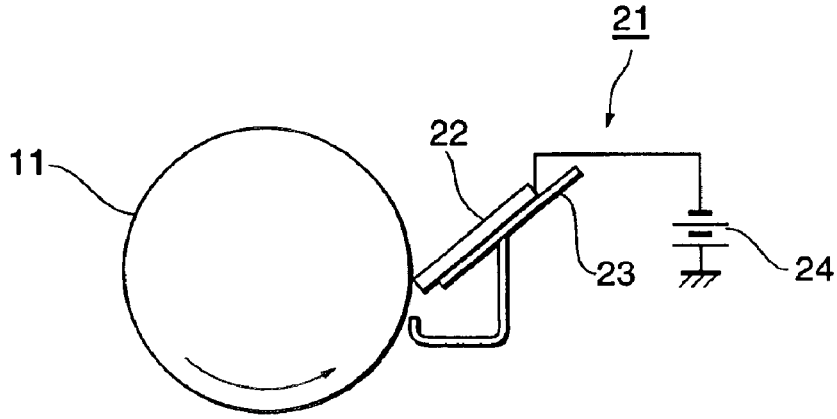
Fig.3 PRIOR ART
FIG. 3 is a drawing showing the main part of another conventional image forming apparatus.

The cleaning blade 44, being different from the conventional cleaning blade 16 ( refer to FIG. 2), does not contain conductive particles. Therefore, the cleaning blade 44 has a very bigger cubic resistance than that of the tape 46 with semi-conductivity, for example, more than 1012 (Ω·cm). Serving as an elastic material, a synthetic resin with a cubic resistance of $10^{12}$ (Ω·cm) can be used to replace the urethane rubber. Further, the tape 46 with semi-conductivity is formed from such semi-conductive material with a cubic resistance of $10^{6}$–$10^{9}$ (Ω·cm), such as PTFE (polytetrafluoroethylene) mixed with carbon black.

Moreover, in the embodiment, the power unit 49 generates a negative voltage of −1300V, the voltage is added to the bracket 48, the conductive tape 45, the tape 46 with semi-conductivity, and the photoconductor drum 11 via the cleaning blade 44. Thus, the photoconductor drum 11 is electrified equally and uniformly, and its surface electric potential becomes −70V.

Further, the sticking position of the tape 46 with semi-conductivity, is set at such a position as to prevent a short circuit between the photoconductor drum 11 and the tape 46 with semi-conductivity and to prevent the toner from stuffing between the tip of the tape 46 with semi-conductivity and the cleaning blade 44, and as to electrify the photoconductor drum 11 sufficiently. That is, the tip of the tape 46 with semi-conductivity is set away at a predetermined isolation distance Lb (edge distance) from the tip i.e. the contacting portion contacting with the photoconductor drum 11, of the cleaning blade 44.

By using the electrifying/cleaning device 35 having the above-described construction, when the photoconductor drum 11 rotates along an arrow direction, the residual toner on the photoconductor drum 11 is scraped away by the cleaning blade 44 pressed by the photoconductor drum 11. Further, when the bracket 48 is added by a voltage of −1300V, the electron moves to the photoconductor drum 11 through the bracket 48, the conductive tape 45, the tape 46 with semi-conductivity, and the cleaning blade 44. Thus, the photoconductor drum 11 can be electrified equally and uniformly.

When sticking the tape 46 with semi-conductivity, it is necessary to make the tape 46 without wrinkles. Thus, it is possible to improve the image quality.

By the way, in the embodiment, the edge distance Lb can be set within 0–1.0 mm, that is: 0<Lb?1.0 mm. Thus, it is possible to keep the image quality. Further, it is desired to set the edge distance Lb within 0.7–0.8 mm, that is: 0.7Lb?0.8 mm.

With respect to the setting of the edge distance Lb, an experiment is performed. In the experiment, as shown by FIG. 7, the tape 46 is stuck on the cleaning blade 44 so that the tape 46 is tilted with respect to the cleaning blade 44, and the isolation distance Lb is set at one edge by 2 mm, and the isolation distance Lb is set at the other edge by about 0 mm. Further, a voltage of −1300V is added to the bracket 48. Then, a printing is performed. In printing, at the right area from the center of the recording medium 37, a normal printing is performed (normal printing); however, at the left area from the center of the recording medium 37, abnormal printing is performed (abnormal printing). Thereby, it is proved that the part of the photoconductor drum 11, corresponding to the right area, is electrified normally, and the part of the photoconductor drum 11, corresponding to the left area, is electrified abnormally.

Because the isolation distance Lb at the center position of the recording medium 37 is about 1 mm, when the isolation distance Lb is set within 0–1.0 mm, it is seen that the photoconductor drum 11 is electrified normally.

The following can be considered. That is:

When a voltage of −1300V is added to the bracket 48 as stated above, the electron moves to the photoconductor drum 11 through the bracket 48, the conductive tape 45, the tape 46 with semi-conductivity, and the cleaning blade 44. Because of this, when the isolation distance Lb is bigger than 1 mm, the resistance of the cleaning blade 44 between the tip of the tape 46 with semi-conductivity and the photoconductor drum 11 becomes bigger. Thus, the electron can not be infused sufficiently to the photoconductor drum 11.

Further, in order to prevent a short circuit between the tape 46 with semi-conductivity and the photoconductor drum 11, the two edges of the cleaning blade 44 are set away at a distance of 1 mm from the two edges of the tape 46. Then, with respect to the conductive tape 45, because it is connected electrically with the bracket 48 and the tape 46, it can be set at any one of the positions along the axis direction of the bracket 48 or the tape 46. In the embodiment, the conductive tape 45 is set at a center position. Moreover, in order to electrify equally and uniformly the photoconductor drum 11, it is necessary to make the conductive tape 45 have a sufficient width.

However, in the embodiment, when forming the cleaning blade 44, because the conductive particles, such as carbon black are not mixed into the urethane rubber, it is possible to prevent the hardness of the rubber from dropping so that the durability of the cleaning blade 44 can be kept. Therefore, even if performing continuous printing, the edge portion of the cleaning blade 44 is not worn away so as not to be nicked. Thereby, it is possible to keep a long and stable cleaning function.

Further, in the embodiment, because the pole of the voltage added on the cleaning blade 44 is negative, it is the same as that of the toner, and it is thus possible to prevent the toner from sticking on the tip of the cleaning blade 44.

<Embodiment 2>

Next, to explain the embodiment 2 of the present invention.

Figure 8:
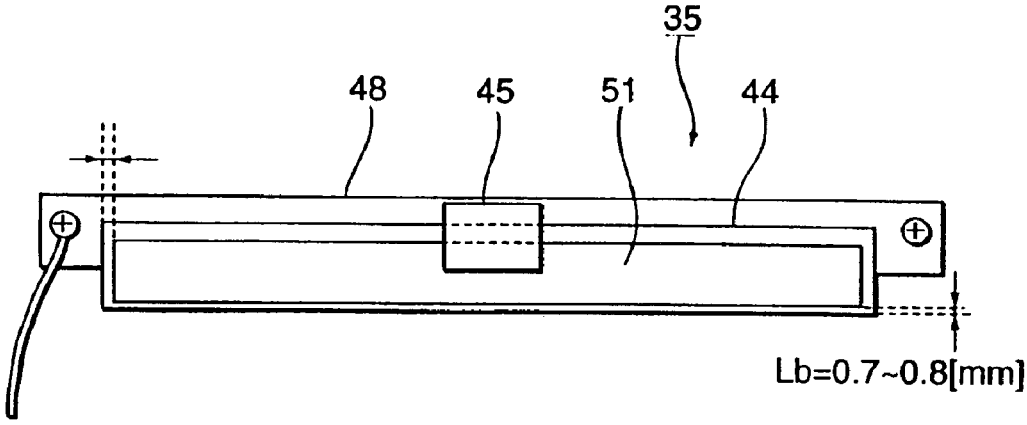
FIG. 8 is a front view showing the main part of a printer of the present invention in embodiment 2.

FIG. 8 is a front view showing the main part of a printer of the present invention in embodiment 2.

In this embodiment, on the cleaning blade 44, a resin plate 51 with semi-conductivity formed from a semi-conductive material having a cubic resistance of 106–109 (??cm) is stuck. The resin plate 51 is formed to have a thickness of 0.1 mm. If the resin plate 51 becomes very thick, there is a possibility to hurt the photoconductor drum 11 (FIG. 4), so it is desired to thin set the resin plate 51.

Because the resin plate 51 with semi-conductivity has a plate shape, not only is it possible to prevent the occurrence of bad manufacture, but it is also possible to prevent the occurrence of wrinkles while sticking on the cleaning blade 44. Therefore, while keeping easily the parallel state between the edge of the resin plate 51 with semi-conductivity and the edge of the cleaning blade 44, the isolation distances Lb at each position along the axis direction of the resin plate 51 or the cleaning blade 44 can easily become the same.

As a result, because the waste toner 19 does not stick on the tip of the cleaning blade 44, it is possible to improve the electrification of the photoconductor drum 11. Therefore, it is possible to correctly perform the printing.

<Embodiment 3>

In order to improve the quality of an image, next, the embodiment 3 is explained.

Figure 9:
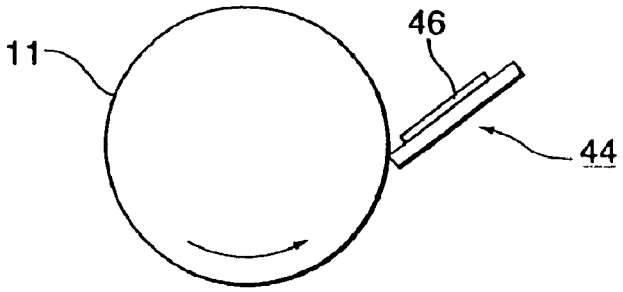
FIG. 9 is a drawing showing the main part of a printer of the present invention in embodiment 3.

FIG. 9 is a drawing showing the main part of a printer of the present invention in embodiment 3.

In this embodiment, on the tip of the cleaning blade 44, semi-conductive particles (not shown) are smeared. Thus, when the photoconductor drum 11 rotates along the arrow direction, the semi-conductive particles are also smeared on the surface of the photoconductor drum 11.

Thereby, the friction between the photoconductor drum 11 and the tip of the cleaning blade 44 becomes small. Thus, the load on the tip of the cleaning blade 44 becomes small. Therefore, even if using the printer for a longtime and using recording mediums beyond a predetermined count, it is impossible to hurt the edge portion of the cleaning blade 44.

Further, because the pressure generated by the photoconductor drum 11 pressing the tip of the cleaning blade 44, is constant, so the scraping function for scraping away the residual toner and the electrification function for electrifying the photoconductor drum 11 do not change.

According to the present invention, the image forming apparatus comprises an image carrier; a blade member contacting elastically with the image carrier; a semi-conductive member installed on the blade member; and a power unit for adding a voltage to the semi-conductive member.

Further, the semi-conductive member is set apart from the contacting portion of the blade member by a predetermined isolation distance Lb.

In the present invention, because the electrifying/cleaning device has the electrifying function and the cleaning function, it is possible to make the image forming apparatus become small and to reduce the cost of the image forming apparatus.

Moreover, because the semi-conductive member is installed on the blade member, when the blade member is formed by an elastic member, it is possible to make the elastic member contain no conductive particles. Thus, it is possible to prevent the hardness of the rubber from dropping so that the durability of the blade member can be kept. Therefore, even if performing continuous printings, the edge portion of the blade member is not worn away so as not to be nicked. As a result, it is possible to keeping a long and stable cleaning function.

The present invention is not limited to the foregoing embodiments but many modifications and variations are possible within the spirit and scope of the appended claims of the invention.

What is claimed is:

1. An image forming apparatus, comprising:

an image carrier;

a blade member having a contacting portion elastically contacting said image carrier;

a semi-conductive member installed on said blade member; and a power unit for providing a voltage to said semi-conductive member;

wherein said semi-conductive member is set apart from said contacting portion of said blade member by a predetermined isolation distance Lb.

2. The image forming apparatus according to claim 1, wherein said isolation distance Lb is set as follows:

$$0<Lb\leqq 1.0 \text{ mm.}$$

3. The image forming apparatus according to claim 1, wherein said isolation distance Lb is set as follows:

$$0.7<Lb\leqq 0.8 \text{ mm.}$$

4. The image forming apparatus according to claim 1, wherein said semi-conductive member is a tape with semi-conductivity.

5. The image forming apparatus according to claim 1, wherein said semi-conductive member is a resin plate with semi-conductivity.

* * * * *